US008783236B2

(12) United States Patent
Achkar

(10) Patent No.: US 8,783,236 B2
(45) Date of Patent: Jul. 22, 2014

(54) ARCHERY BOW AND ARCHERY BOW CAM

(76) Inventor: Nibal Achkar, Saskatchewan (CA)

( * ) Notice: Subject to any disclaimer, the term of this patent is extended or adjusted under 35 U.S.C. 154(b) by 667 days.

(21) Appl. No.: 12/642,887

(22) Filed: Dec. 21, 2009

(65) Prior Publication Data

US 2011/0146644 A1 Jun. 23, 2011

(51) Int. Cl.
*F41B 5/10* (2006.01)

(52) U.S. Cl.
USPC ..... 124/25.6

(58) Field of Classification Search
CPC ..... F41B 5/10; F41B 5/105; F41B 5/14; F41B 5/123; F41B 5/1449
USPC ..... 124/25.6
See application file for complete search history.

(56) References Cited

U.S. PATENT DOCUMENTS

| | | | | |
|---|---|---|---|---|
| 4,074,409 | A | 2/1978 | Smith | |
| 4,077,385 | A | 3/1978 | Fredrickson | |
| 4,195,397 | A | 4/1980 | Saunders | |
| 5,022,377 | A | 6/1991 | Stevens | |
| 6,032,660 | A * | 3/2000 | Hervig | 124/25.6 |
| 6,698,413 | B1 * | 3/2004 | Ecklund | 124/25.6 |
| 7,082,937 | B1 * | 8/2006 | Land | 124/25.6 |
| 7,980,235 | B1 * | 7/2011 | Kronengold et al. | 124/1 |
| 2006/0174859 | A1 * | 8/2006 | Andrews | 124/25.6 |
| 2010/0051005 | A1 * | 3/2010 | Wilson | 124/25.6 |
| 2010/0147276 | A1 * | 6/2010 | Wilson et al. | 124/25.6 |
| 2011/0023857 | A1 * | 2/2011 | Grace | 124/25.6 |

* cited by examiner

*Primary Examiner* — Gene Kim
*Assistant Examiner* — Amir Klayman
(74) *Attorney, Agent, or Firm* — Eckert Seamans Cherin & Mellott, LLC; David C. Jenkins

(57) ABSTRACT

An archery bow and cam apparatus having an anti-rotation cam stop mechanism which permits loosening of the bow string, loosening of a cable, or loosening of the bow string and a cable. The anti-rotation means may comprise an aperture or series of apertures through the cam and a member insertable in the aperture. The member can extend through the cam assembly and contact the limb of the bow to prevent the cam from rotating back to a resting or static position. The invention is particularly suited for a compound bow or compound crossbow having one or more cams, and a combination of a bow string and power cable, such the bow string may be detensioned by increasing the tension on the power cable, and vice versa, upon stopping free rotation of the cam.

22 Claims, 10 Drawing Sheets

ARCHERY BOW AND ARCHERY BOW CAM

FIELD OF THE INVENTION

The invention relates to archery bows, and specifically to a compound bow or compound cross bow of the type having a bow string, one or more power cables, and a cam or cams for tensioning the string and cable. The invention further relates to a system and method for loosening the bow string or one of the power cables to enable maintenance to be carried out on the loosened cable or string.

BACKGROUND

A compound archery bow typically comprises a rigid center riser, a handle grip and a pair of flexible limbs extending from the opposing end portions of the riser. The compound bow has the bow string attached to one or more pulleys (cams), + the pulleys to turn. This causes the pulleys to pull the cables, which in turn causes the limbs to bend and thus store energy. A single cam bow typically includes a wheel mounted to the upper limb and a cam assembly mounted to the lower limb (the terms upper and lower are purely for convenience of description). A dual cam bow includes a cam assembly on each of the upper and lower limbs. Power or tension cables are also connected between the two limbs via the cams and wheels. The cam assembly provides a mechanical advantage.

Proper stringing and tensioning of the bow strings and cables is important for achieving optimum performance. The bow string, and cables are adjusted to set the proper cam positioning and the desired length, by changing the position or replacing the draw module mounted to the cam assembly of the bow. Adjustments and maintenance also may be performed as the bow, materials in the limb, bow string and power cable change due to age and use. Other adjustments and maintenance may be performed to replace components such as the bow string or power cable; to add accessories to the bow such as a peepsight or silencer; or to change or modify other components. It is sometimes necessary or desirable to perform these operations in the field, often under adverse conditions.

Since the bow string and power cables are constantly under tension, repair work or maintenance on the bow, cam and strings or cables themselves requires a compressive force to squeeze or compress the bow limbs together and provide slack in the bow string or cables. Typically, a bow press is used for this purpose. A bow press is often relatively large and heavy, and usually is located in a repair shop and is not readily available in the field. Without a bow press, adjustments or repair to equipment in the field are difficult or impossible to perform.

One solution has been to provide a portable bow press, such as those disclosed in U.S. Pat. No. 5,022,377 to Stevens and U.S. Pat. No. 4,077,385 to Fredrickson. Another proposed solution is disclosed in U.S. Pat. No. 4,195,397 to Saunders and U.S. Pat. No. 4,074,409 to Smith, which disclose apparatus for use in the restringing of a compound bow which include a number of hooks attachable to string segments of the bow.

SUMMARY

In one embodiment, the disclosed and claimed concept relates to a cam and an associated cam stop which permits the user to prevent rotation of the cam in a selective fashion so as to permit loosening of the bow string, loosening of a cable or loosening of the bow string and a cable. The cam stop may comprise an aperture through the cam, which receives a pin or other lock member in a fashion which permits the pin to protrude laterally from the cam so as to engage a portion of the bow to prevent the cam from rotating past the engagement position and back to a static position. A series of apertures, may be provided in the cam to permit multiple engagement positions. A lock mechanism may be used on the limb of the bow for engaging the cam and locking the cam in a position rotated away from the static position. The lock mechanism may include a rigid stop or ratchet mechanism mounted on the limb and activated to prevent the cam from rotating in one or more directions.

To loosen the bow string in order to perform maintenance, the cam is rotated a few degrees, for example by a user pulling the bow string a few inches. At this point, the cam stop is actuated. The bow string may be released and the cam stop prevents rotation of the cam back to a resting position. As a result, the bow string is then maintained in loosened state. The force of the limbs diverging away from each other is wholly counteracted by the tension in the power cable. The cam stop prevents equalization of the tensioning force through the bow string, thereby permitting the bow string to remain loose and for maintenance on or replacement of the bow string. To loosen a power cable in order to perform maintenance, a similar procedure may be performed by pulling the power cable to cause rotation of the cam and actuating the cam stop. The cam stop prevents equalization of the tensioning force through the power cable and the limbs are held under tension by the bow string, thereby permitting the power cable to remain loose and for maintenance on or replacement of the power cable.

For a single cam bow, the power cable can be placed under tension and the bow string is loosened, allowing work to be performed on the bow string. Alternatively, for a single cam bow, the bow string can be placed under tension and the power cable is loosened, allowing work to be performed on the power cable. Additional work or maintenance may be performed on the cam, bow, bow string or cables with the rotation of the cam locked. For a dual cam bow, one of the bow strings or cables may be pulled to rotate the cam at the upper or lower limb, placing one of the power cables under tension and loosening the bow string and the second power cable.

According to an embodiment of the present disclosure, there is provided a cam for engaging a bow string and power cable of an archery bow, the archery bow having opposed limbs. The cam comprises: a cam body; a mount for rotatably mounting the cam body to one of the limbs about an axis; at least one first cam surface on the cam body for receiving the bow string; at least one second cam surface on the cam body for receiving the power cable; and a selectively actuatable cam stop to prevent rotation of the cam about the axis in a first direction beyond a first circumferential position when the cam stop is actuated. The first circumferential position permits detensioning of the bow string or the power cable when engaged to the cam surfaces. The cam stop may be de-actuated to permit free rotation of the cam body about the axis in either direction to restore tension on the bow string or power cable.

According to another embodiment of the present disclosure there is provided an archery bow comprising: a pair of opposed limbs; a bow string routed between said limbs; at least one power cable routed between said limbs; and at least one cam rotatably mounted to one of said limbs. The cam comprises a cam body, at least one first cam surface on the cam body for receiving the bow string and at least one second cam surface on the cam body for receiving the power cable.

The bow includes a selectively actuatable cam stop to prevent rotation of the cam about the axis in a first direction beyond a first circumferential position when actuated. The first circumferential position permits detensioning of the bow string or the power cable. The cam stop may be de-actuated to permit free rotation of the cam body about the axis in either direction to restore tension on the bow string or power cable.

According to another embodiment of the present disclosure there is provided a method for decreasing tension in a bow string or power cable of an archery bow to perform maintenance thereon. The method comprising the steps of: providing an archery bow comprising a pair of opposed bow limbs, a bow string, at least one power cable, and at least one cam rotatably mounted to one of the limbs, the cam configured to equalize the tension on the power cable and bow string, the power cable and the bow string being under tension; rotating the cam in a first direction; and actuating a cam stop to prevent back-rotation of the cam in a second direction opposed to the first direction. Actuating the cam stop locks the cam at a first circumferential position thereby increasing tension in the power cable or the bow string, and decreasing tension in the other of the bow string or the power cable.

According to another embodiment of the present disclosure there is provided a method for decreasing tension in a bow string or power cable of an archery bow to perform maintenance thereon. The method comprises the steps of: providing an archery bow comprising an upper limb and an opposed lower limb, a bow string, at least two power cables, an upper cam rotatably mounted the upper limb, and a lower cam rotatably mounted to the lower limb, the upper cam and lower cam configured to equalize the tension on the power cables and the bow string, the power cables and the bow string being under tension; rotating one of the upper cam or the lower cam in a first direction; and actuating a cam stop to prevent back-rotation of the rotated upper or lower cam in a second direction opposed to the first direction. Actuating the cam stop locks the upper cam or lower cam at a first circumferential position thereby increasing tension in one of the power cables and decreasing tension in the bow string and in the other of the power cables.

Directional references employed in the specification or claims, such as "upper," "lower," "left," "right," "clockwise," "counter-clockwise" and the like are employed for ease of description and are not intended to limit the scope of the invention in any respect. It will be readily apparent that an archery apparatus according to the present disclosure may be oriented in any direction.

BRIEF DESCRIPTION OF THE DRAWINGS

The following detailed description when read in connection with the accompanying drawings describes embodiments of the invention. The various features of the drawings are not necessarily to scale.

Figure 1:
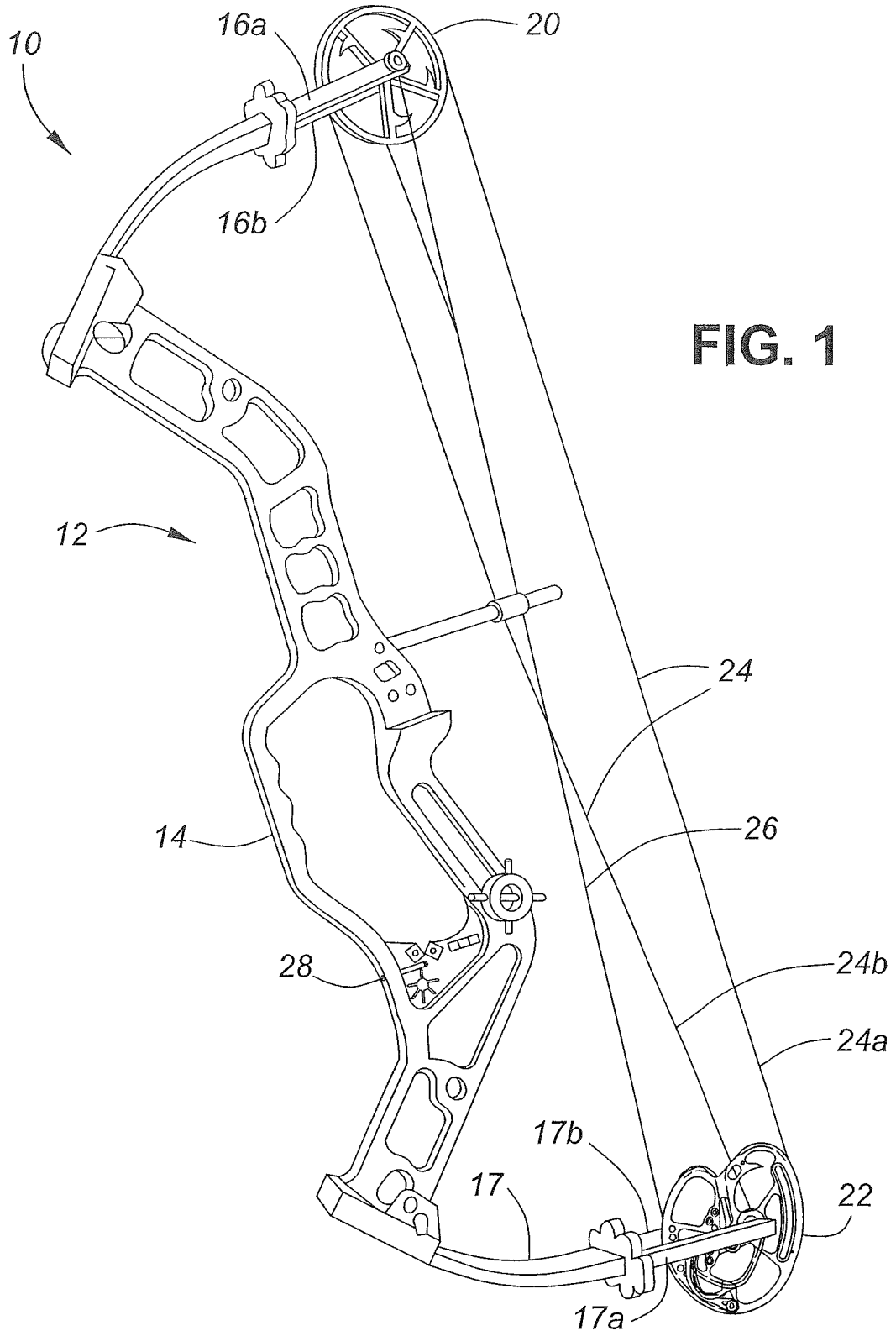
FIG. 1 is a perspective view of an single cam bow according to the present disclosure.

While the invention will be described in conjunction with the illustrated embodiments, it will be understood that it is not intended to limit the invention to such embodiments. On the contrary, it is intended to cover all alternatives, modifications and equivalents as may be included within the scope of the invention as defined by this specification as a whole, including the appended claims.

DETAILED DESCRIPTION

In the following description, similar features have been given similar reference numerals. The apparatus and method are described below in relation to single and dual cam archery bows but will be understood by those skilled in the art to apply to other types of compound bows, including a cam and a half bow, binary cam bow or compound cross bow.

FIG. 1 illustrates a single cam archery bow 10 having a rigid riser 12 with an integral carrying handle 14. Upper and lower limbs 16 and 17 extend from opposing ends of the riser 12. Limbs 16 and 17 may be substantially parallel to each other or disposed at a diverging angle, depending on the desired features of the bow. Limbs 16 and 17 terminate at their distal ends in spaced forks 16*a*, 16*b* and 17*a*, 17*b* respectively. A freely rotatable wheel 20 is mounted to upper limb 16 at the top of the bow 10, journalled on an axle (not shown) for free rotation in either direction. The axle spans the forks 16*a*, 16*b*. A cam 22 is mounted to lower limb 17 on an axle 32 which spans the forks 17*a*, 17*b*. A bow string 24 and power cable 26 are strung between the wheel 20 and cam 22. A first end loop 24*a* of the bow string 24 is attached to the cam 22. The bow string 24 is then routed around the wheel 20 and returns to cam 22, and is fastened to cam 22 at a second end loop 24*b*. FIG. 1 also illustrates a member 28, which comprises a component of the cam stop described below, stored in a slot in the carrying handle 14 for storage adjacent to a tool supporting body 30. The member 28 can be stored in any convenient fashion, for example a clip may be provided at any convenient location on bow 10, or the member 28 may be stored in a convenient receptacle within the bow 10.

Figure 2:
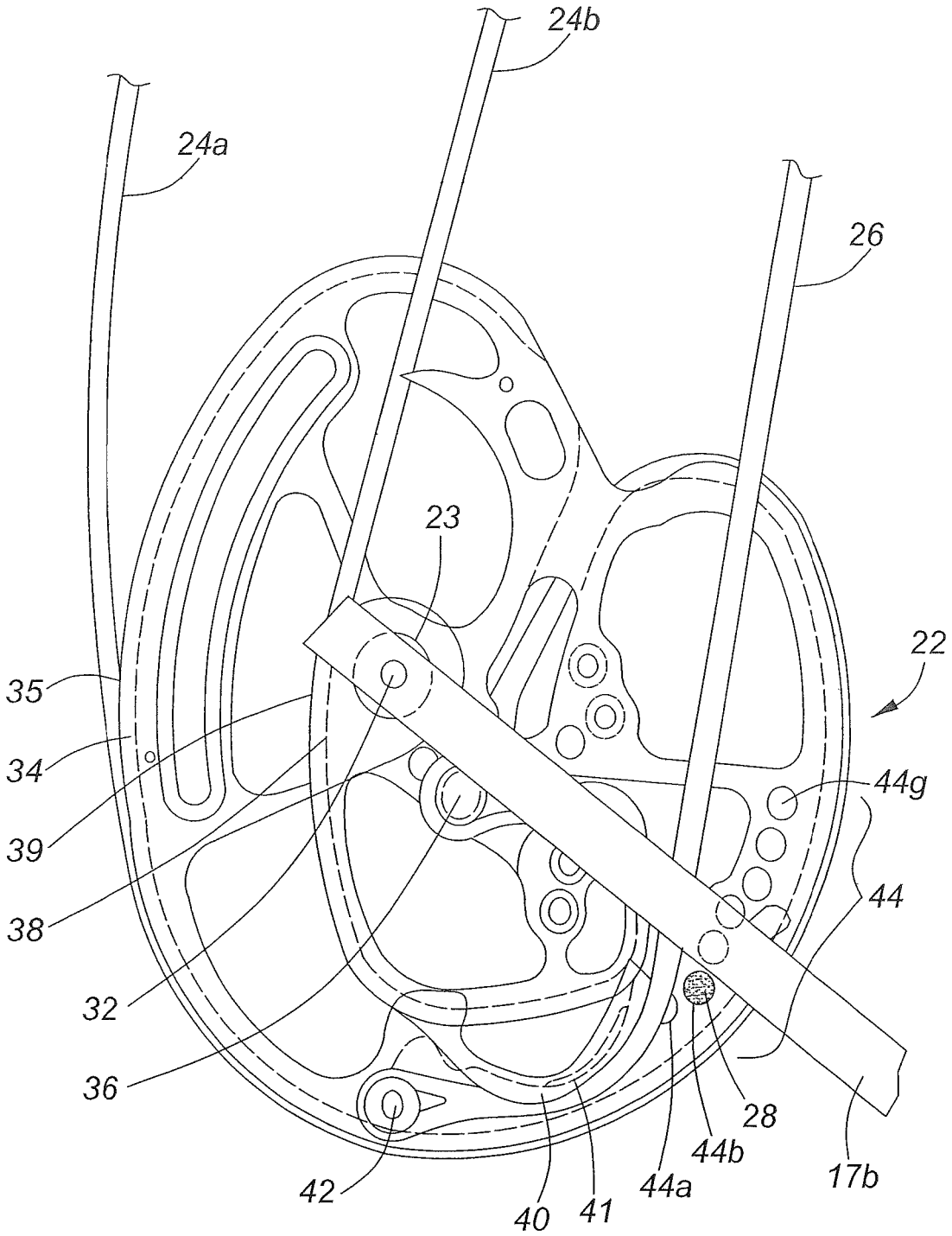
FIG. 2 is a detailed side view of the cam portion of a single cam bow and a cam lock, and related components according to the present disclosure.

FIG. 2 provides a detailed view of the cam 22 of FIG. 1, showing a side view opposite the side illustrated in FIG. 1, wherein loop 24*a* of bow string 24 appears on left hand side of FIG. 2. The cam 22 includes a hub 23, which is rotatably mounted on axle 32 extending between forks 17*a* and 17*b*. The hub 23 is located at an eccentric position within cam 22, so as to provide eccentricity as the cam 22 is rotated.

The cam 22 consists of a structure having an irregular generally disc-shaped body rotatable about an axle 32. The rim of the disc-shaped body is configured to provide a cam surface around a portion of its perimeter. The cam 22 includes one or more tracks 34, 38, 40 that each provide a cam surface that receives a corresponding bow string or cable, for progressively retracting and releasing the bow string 24 or power cable 26. Each track comprises a groove 35, 39, 41 for receiving either the bow string 24 or a power cable 26. Track 34 receives the bow string 24 within the groove 35. Track 34 extends substantially around the periphery of cam 22 and thus has essentially the same configuration as the periphery of cam 22. End loop 24*a* of the bow string 24 is attached to the cam 22 at a string anchor 36, located near the middle of cam 22. The second end loop 24*b* of the bow string 24 is routed around second track 38 and groove 39 and also is attached to the string anchor 36. Power cable 26 is routed around a third track 40 and groove 41 and is attached to the cam 22 at a cable anchor 42.

Both ends of the bow string 24 engage the cam 22 adjacent circumferential locations of the tracks 34, 38. Power cable 26 engages cam 22 at a circumferential location generally opposed to the location where the bow string engages cam 22. As a result, tensioning of power cable 26 rotates cam 22 so as to tighten bow string 24 and vice versa.

When the bow 10 is in a static, tensioned configuration, wherein bow 10 is ready for use and the bow string 24 is not drawn, the cam 22 remains in a static position wherein respective rotationary forces of the bow string 24 and the power cable 26 balance each other. As the bow string 24 is drawn, cam 22 rotates in a first direction and the power cable 26 is wound around the track 40 and groove 41, thereby drawing the limbs 16, 17 of the bow 10 together. When the bow string 24 is released, the cam 22 rotates in an opposite, second direction from the first direction, releasing tension on the power cable 26 and wrapping the bow string 24 around tracks 34, 38. Cam 22 rotates back to the static position. During use, the cam 22 rotates approximately 180 to 270 degrees, depending on the type of bow and the draw length of the user.

Performing maintenance on the bow 10, cam 22, bow string 24 or power cable 26 typically requires reducing or removing the tension on the bow string 24 or the power cable 26. By rotating the cam 22 in either a clockwise or counterclockwise direction, and preventing rotation of the cam 22 back to the static position, tension in the bow string 24 or the power cable 26 is reduced or removed. To prevent rotation of the cam 22, a cam stop is provided. It will be seen that various types of cam stops may be employed, which serve to selectively prevent the cam from rotating and returning to its original static position. Depending on the type of cam stop used it may prevent the cam from rotating in either a clockwise or counterclockwise direction or the cam stop may prevent rotation of the cam 22 in both clockwise and counterclockwise directions. In the described embodiment, the cam stop comprises one or more apertures 44 within the cam 22 for receiving a removable member 28. Apertures 44 extend in a linear array adjacent to the periphery of cam 22. The array is curved to match the periphery of cam 22 and is sufficiently long to provide a range of cam stop positions, in order to accommodate various configurations and tensions on the respective string and cables. The apertures 44 are spaced reasonably close together, but with sufficient spacing to ensure robustness of the cam 22. For example, in one embodiment, the series of apertures 44 comprises 8 apertures extending across a span approximately 1.5 inches long at the periphery of the cam 22; the apertures 44 are approximately 3/16 inches in diameter and spaced apart 1/4 inch from center to center.

Apertures 44 are located on cam 22 so as to be adjacent to forks 17*a*, 17*b* when the bow is in its normal tensioned configuration. The array of apertures 44*a*-44*g* allows for a range of circumferential or stop positions of cam 22 as described below. Member 28 is preferably cylindrical to match apertures 44, but may alternatively have other configurations. Member 28 fits snugly within aperture 44 so as to prevent inadvertent slippage, but can still be readily removed without undue difficulty, even in adverse conditions. Member 28 protrudes outwardly in a lateral direction from one and preferable both sides of cam 22 when properly inserted, so as to contact one or both of forks 17*a* and 17*b* when cam 22 is rotated. Member 28 is thus brought into contact with the forks 17*a*, 17*b* as cam 22 rotates in the direction of the forks 17*a*, 17*b*. When thus engaging one or both of forks 17*a*, 17*b*, member 28 prevents further rotation of the cam 22 in the direction of contact.

In order to use the cam stop to detension the bow string 24, a user holds the bow 10 in a position for maintenance. For example, by holding the riser 12, the user may hold the bow string 24 with their foot and pull on the riser 12 slightly in order to initiate rotation of the cam 22. For the purposes of illustration, and with reference to FIG. 2, the cam 22 is rotated in a clockwise direction in this step. The cam stop is then actuated to prevent back-rotation of cam 22 in the counterclockwise direction. This is accomplished by inserting member 28 into an appropriate aperture 44 which is closest to the forks 17*a* and 17*b* so as to minimize the back-rotation of cam 22 when the bow string 24 is released. Upon insertion of member 28, the bow string 24 is released, thereby permitting a small amount of back-rotation of cam 22 until member 28 engages and bears on forks 17*a* and 17*b*, thereby stopping the cam 22 in a circumferential position, preventing further rotation and countering the tension applied by power cable 26. Member 28 is firmly retained within the aperture 44 by its engagement of the limb 17. Member 28 is thus urged against the forks 17*a*, 17*b* by the tension of cable 26 acting on cam 22. At this stage, the bow string 24 is detensioned and maintenance or other work may be performed on the bow string 24. Typically, the bow string 24 is pulled a few inches and the cam 22 rotated a few degrees before actuating the cam stop in order to relax tension on the bow string 24.

To remove the member 28 and return the cam 22 to a static position, the bow string 24 is pulled slightly to initiate clockwise rotation of the cam 22 and release the member 28 from being urged against the limb 17 or forks 17*a*, 17*b*. With the bow string 24 and cam 22 held in this position, the member 28 can be removed from the aperture 44. The bow string 24 can be gently released to allow the cam 22 to rotate back to the static position.

In one embodiment, member 28 is a cylindrical pin approximately 1.5 inches long and is comprised of hardened stainless steel. It will be appreciated that the dimensions and configuration of member 28 may be varied depending on the configuration, spacing and dimensions of the cam 22, limb 17, forks 17*a*, 17*b* and apertures 44. Further, member 28 and aperture 44 are illustrated as a cylindrical pin and corresponding circular hole. It will be appreciated that members and corresponding apertures of other configurations may be provided. Since member 28 is urged against the limb 17 and forks 17*a*, 17*b*, the aperture 44 may be sized somewhat larger than the member 28. Alternatively, member 28 may be curved to hook onto the forks 17*a*, 17*b*. In another embodiment, member 28 may be non-removable from cam 22, such as a releasable spring-loaded pin that can be moved between extended and retracted positions.

Figure 5:
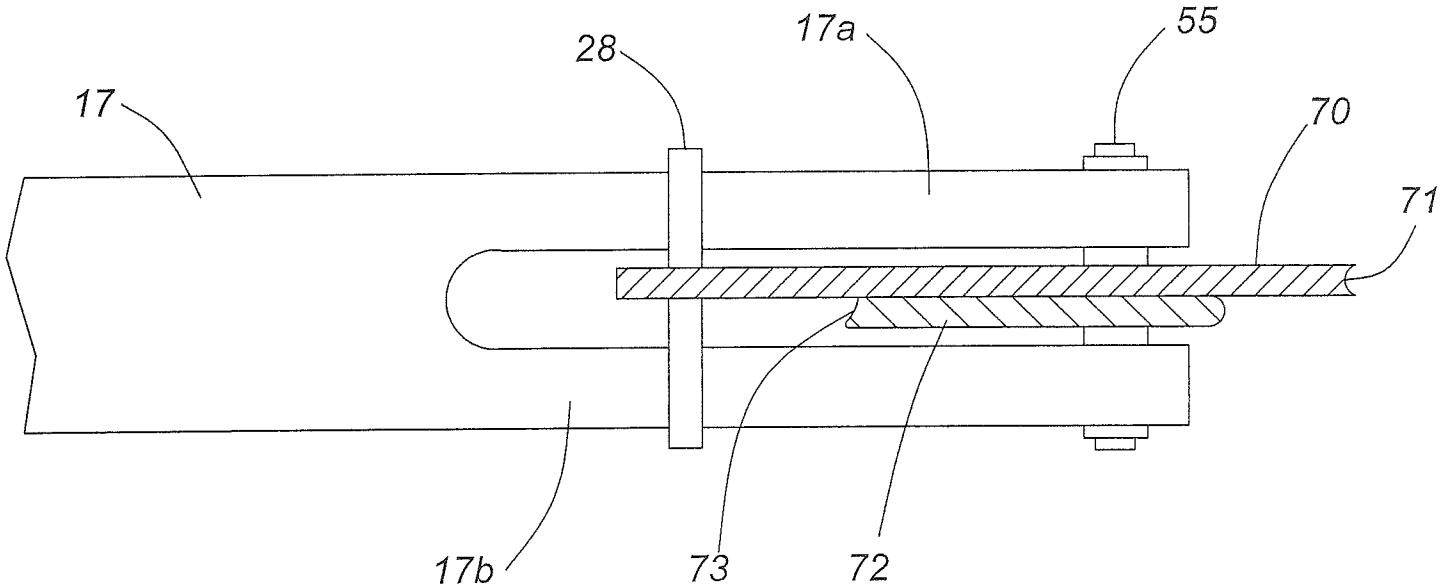
FIG. 5 is a bottom view of the cam and cam lock of FIG. 4 for a solid limb bow.
Figure 5A:
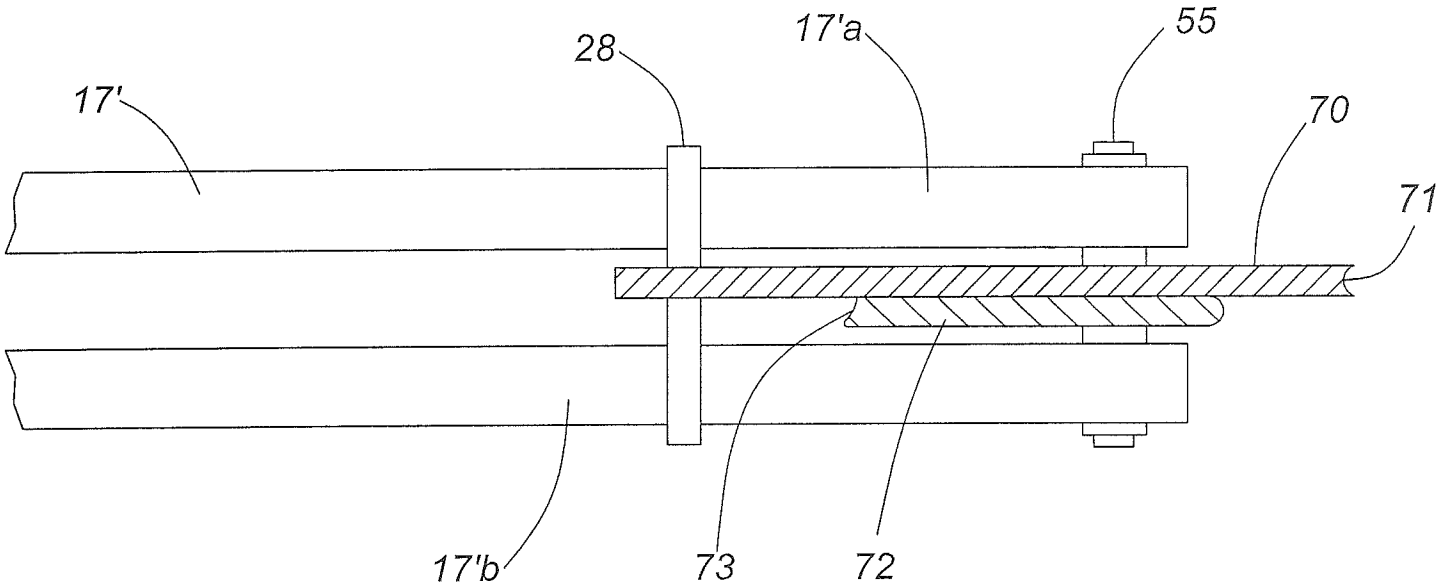
FIG. 5A is a bottom view of the cam and cam lock of FIG. 4 for a split limb bow.

In a preferred embodiment, member 28 is dimensioned to engage both of the forks 17*a*, 17*b* of the limb 17 of a solid limb bow. Similarly, for a bow 10 having a split limb 17' as shown in FIG. 5A, member 28 may be dimensioned to engage both limbs 17'*a* and 17'*b*.

To relax tension on the power cable 26 on the single cam bow 10 in FIG. 2, the power cable 26 is pulled to rotate the cam 22 in the direction of the power cable 26. A user holds the bow 10 in a position for maintenance, such as by holding the riser 12. For example, the user may pull the power cable 26 away from the riser 12 to initiate rotation of the cam 22. For the purposes of illustration, and with reference to FIG. 2, the cam 22 rotates in a counter-clockwise direction. With the power cable 26 and cam 22 held in this position, the member 28 is inserted into an aperture 44*d* appearing adjacent or above the forks 17*a*, 17*b*. The power cable 26 is released slowly, allowing cam 22 to rotate slightly in a clockwise direction. As the cam 22 rotates back, the member 28 is urged against the forks 17*a*, 17*b* thereby stopping the cam 22 in a circumferential position. Cam 22 is prevented from rotating further in the clockwise direction back to the static position. At this stage, the power cable 26 is relaxed and maintenance or other work may be performed on the power cable 26. Typically, the power cable 26 is pulled a few inches and the cam 22 rotated a few degrees in order to relax tension on the power cable 26.

Upon insertion of member 28, the bow string 24 is released, thereby permitting a small amount of back-rotation of cam 22 until member 28 engages and bears on forks 17*a* and *b*, thereby stopping the cam 22 in a first circumferential position, preventing further rotation and countering the tension applied by power cable 26.

It will be appreciated that in performing work on either the bow string 24 or power cable 26, moderate rotation and release of the cam 22 are used to ensure the bow string 24 and power cable 26 remains in the appropriate tracks 34, 38, 40 and grooves 35, 39, 41 in the cam 22.

Figure 3:
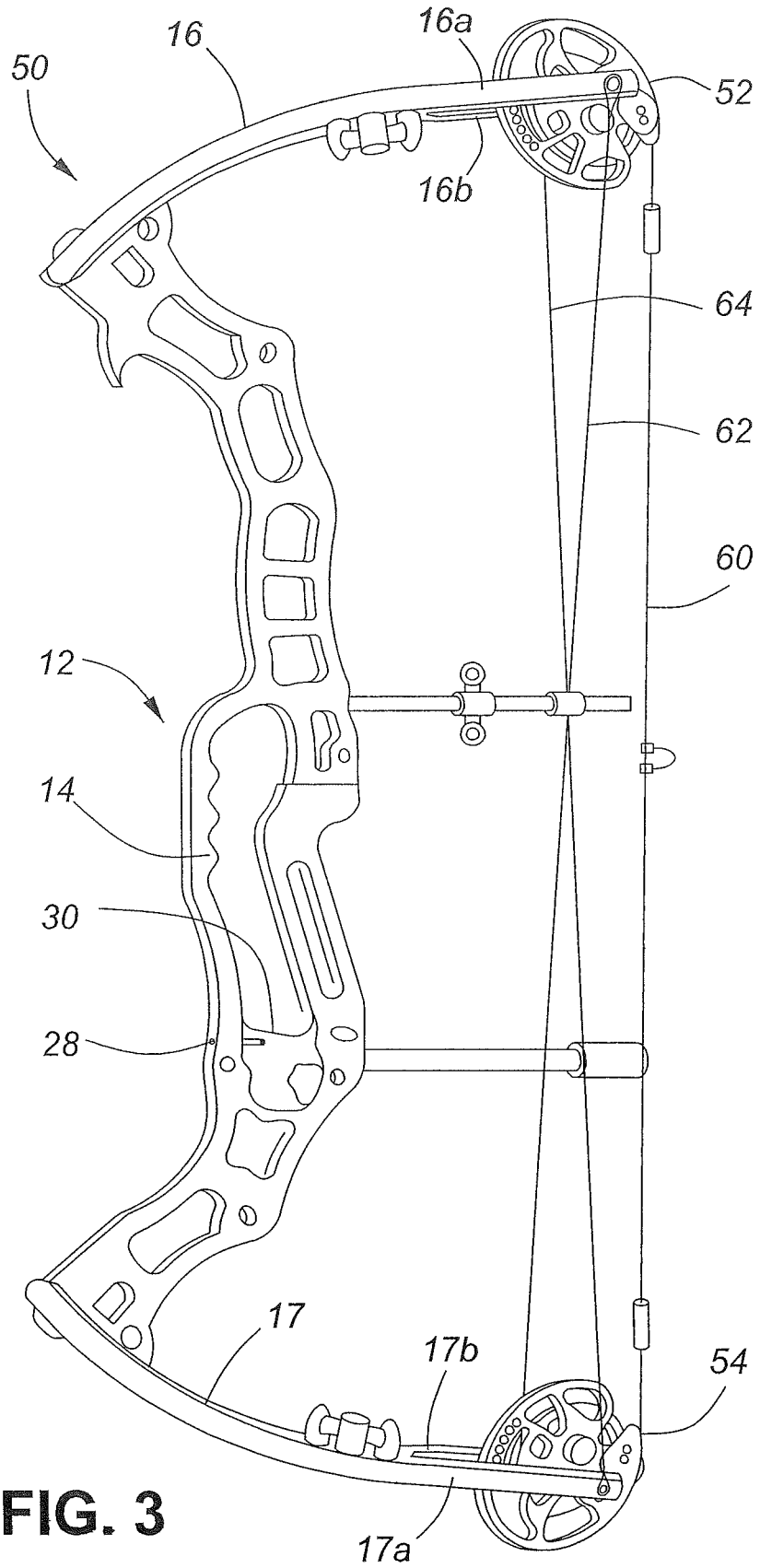
FIG. 3 is a perspective view of a dual cam bow according to the present disclosure.

FIG. 3 illustrates a dual cam bow 50 having a riser 12 and integral carrying handle 14. Upper and lower limbs 16 and 17 extend from opposing ends of the riser 12. The limbs 16, 17 terminate at their distal ends in spaced forks 16*a*, 16*b* and 17*a*, 17*b* respectively. An upper cam 52 is mounted to the limb 16 at the top of the bow 10 on an axle 53 which span the forks 16*a*, 16*b*. A lower cam 54 is mounted to the limb 17 on an axle 55 which spans the forks 17*a*, 17*b*. The upper cam 52 and lower cam 54 typically are mounted in a mirror image fashion. A bow string 60 and first and second power cables 62, 64 are mounted and routed between the cams 52, 54 in a conventional manner.

Figure 4:
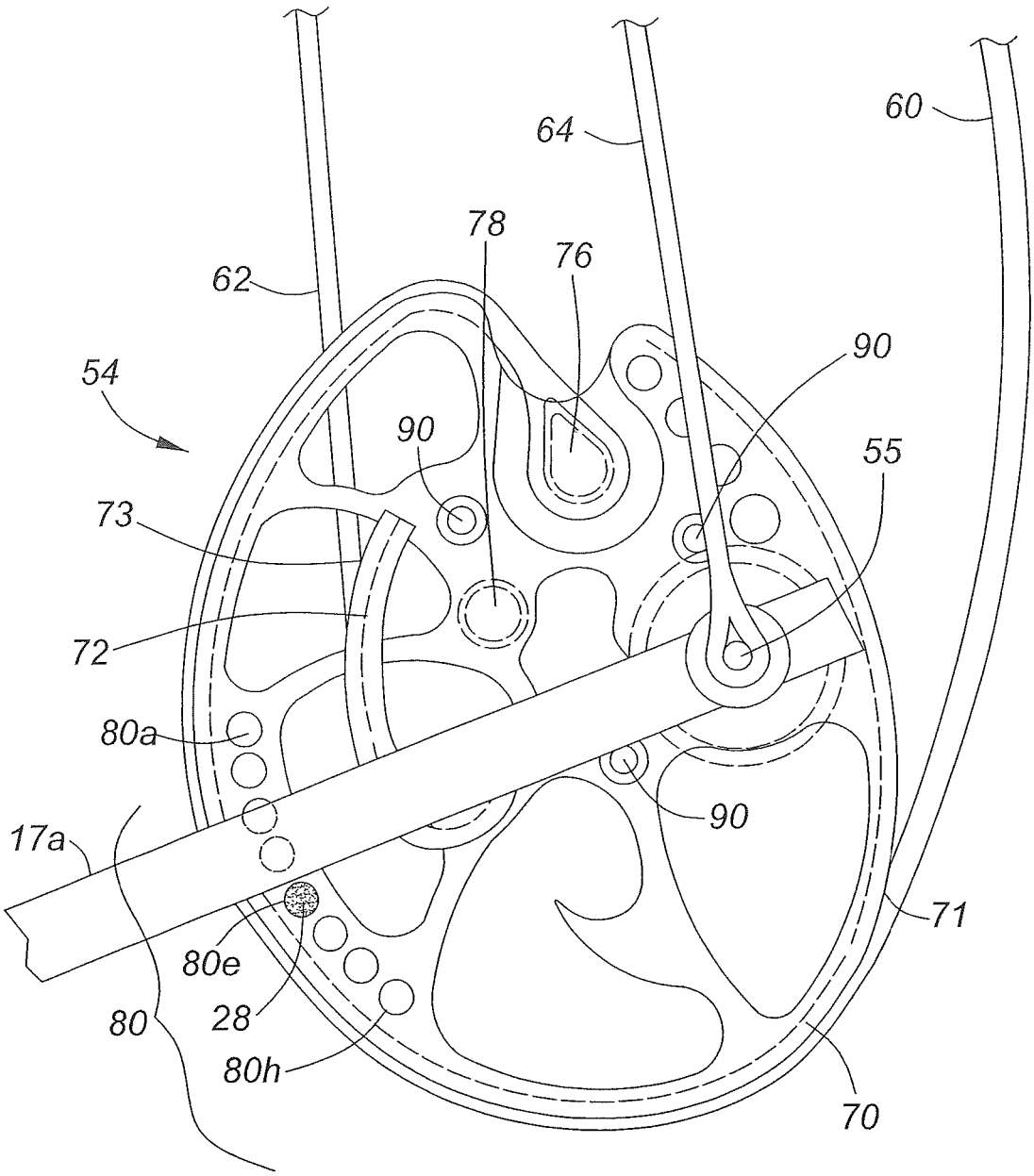
FIG. 4 is a detailed side view of a cam of a dual cam bow and a cam lock and related components according to the present disclosure.

A detailed view of the lower cam 54 of the dual cam bow 50 is illustrated in FIG. 4. The cam 54 of the dual cam bow 50 typically includes two tracks 70, 72. Each track 70, 72 has a corresponding groove 71, 73 respectively for receiving the bow string 60 and one of the power cables 62, 64. The grooves form cam surfaces for receiving the bow string 60 or power cables 62, 64. The bow string 60 is routed around the track 70 in the groove 71 and is attached at a string anchor 76. The second end of the bow string 60 is routed around and attached at the upper cam 52 in a similar fashion. The first power cable 62 is routed around the track 72 in groove 73 and is attached at a cable anchor 78. The second power cable 64 is attached to the lower cam 54 at the axle 55 and is routed to the upper cam 52.

The first and second power cables 62, 64 are routed and attached at the upper cam 52 in complementary fashion. The first power cable 62 is attached at the axle 53 of the upper cam 52. The second power cable 64 is routed around a second track and groove in the cam 52 and attached a cable anchor on the cam 52. The upper cam 52 includes a similar cam stop as described below for the lower cam 54, although configured as a mirror image thereof.

One or more apertures 80 for receiving the member 28 are located in the cam 54. The apertures 80 are located adjacent to the paths of the forks 17*a*, 17*b* over the cam 54. As described above, the apertures 80 may include a series of apertures 80*a*-80*h* located adjacent to the periphery of the first track 70 of the cam 54. The apertures 80 may be circular for receiving a cylindrical member 28, but a number of shapes and configurations may be used.

In order to relax tension in the bow string 60 and one of the power cables 62, 64, the cam 54 may be rotated slightly and held in this circumferential position by actuation of the cam stop. As illustrated in FIG. 5, the cam stop may comprise a member 28 inserted through an aperture 80 in the track 70. The member 28 is urged against the forks 17*a*, 17*b* of the limb 17, thus preventing rotation of the cam 54 back to a static position. Member 28 is firmly retained within the aperture 80 by its engagement of the limb 17 member 28 is urged against the forks 17*a*, 17*b* by the tension of the one of the power cables 62, 64.

When working on the dual cam bow 50, tension in the bow string 60 and one of the two power cables 62, 64 may be relaxed at the same time, with the other power cable maintaining tension between the limbs 16, 17 of the bow 50. Tension in the bow string 60 may be relaxed by locking either the upper cam 52 or lower cam 54. Tension in the first power cable 62 may be relaxed by locking the upper cam 52 and tension in the second power cable 64 may be relaxed by locking the lower cam 54.

With reference to the cam 54 illustrated in FIG. 4, to relax tension on the bow string 60 and the second power cable 64 of the dual cam bow 50, a user holds the bow 50 in a position for maintenance, such as by holding the riser 14. The bow string 60 is pulled to rotate the cam 54 in the direction of the bow string 60. For the purposes of illustration, and with reference to FIG. 4, the cam 54 is forced to rotate in a counter-clockwise direction. With the bow string 60 and cam 54 held in this position, the cam stop is actuated. For example, the member 28 is then inserted into an aperture, such as aperture 80*e*, appearing adjacent to the forks 17*a* and 17*b*. The bow string 60 is slowly released, allowing the cam 54 to rotate back slightly in a clockwise direction. As the cam 54 rotates back, member 28 is urged against the forks 17*a*, 17*b* thereby stopping the cam 54 in a circumferential position. The cam 54 is prevented from rotating back to a static position. At this stage, both the bow string 60 and second power cable 64 are relaxed. Tension between the limbs 16, 17 of the bow 50 is maintained by the first power cable 62, and maintenance or other work may be performed on the bow string 60 and second power cable 64. Typically, the bow string 60 is pulled a few inches and the cam 54 rotated a few degrees in order to relax tension on the bow string 60 and the second power cable 64.

To remove member 28 and return the cam 54 to a static position, the bow string 60 is pulled slightly to initiate counter-clockwise rotation of the cam 54. With the bow string 60 and cam 54 held in this position, the member 28 is then removed. The bow string 60 can be gently released to allow the cam 54 to rotate in a clockwise direction and return to a static position.

To relax tension in the first power cable 62, and again in the bow string 60, a similar procedure is performed with the bow string 60 and the upper cam 52. In this configuration, the bow string 60 and first power cable 62 are relaxed. Tension between the limbs 16, 17 of the bow 50 is maintained by the second power cable 64.

As illustrated in FIG. 4, locking of the cam 54 against rotation allows other maintenance to be performed on the bow 50 or cam 54. A shooting module (not shown) may be mounted to a side of the cam 54 at module attachment points 90. For example, a module may be screwed or bolted to the attachment points 90. With the cam 54 in a static position, the attachment points 90 may be blocked by the forks 17*a*, 17*b* of the limb 17 of the bow 50, thus preventing easy replacement or tightening of the module. Rotation and locking of the cam 54 as described above may be performed to move the attachment points 90 away from the forks 17*a*, 17*b* and enable clear access to the attachment points 90.

Figure 6:
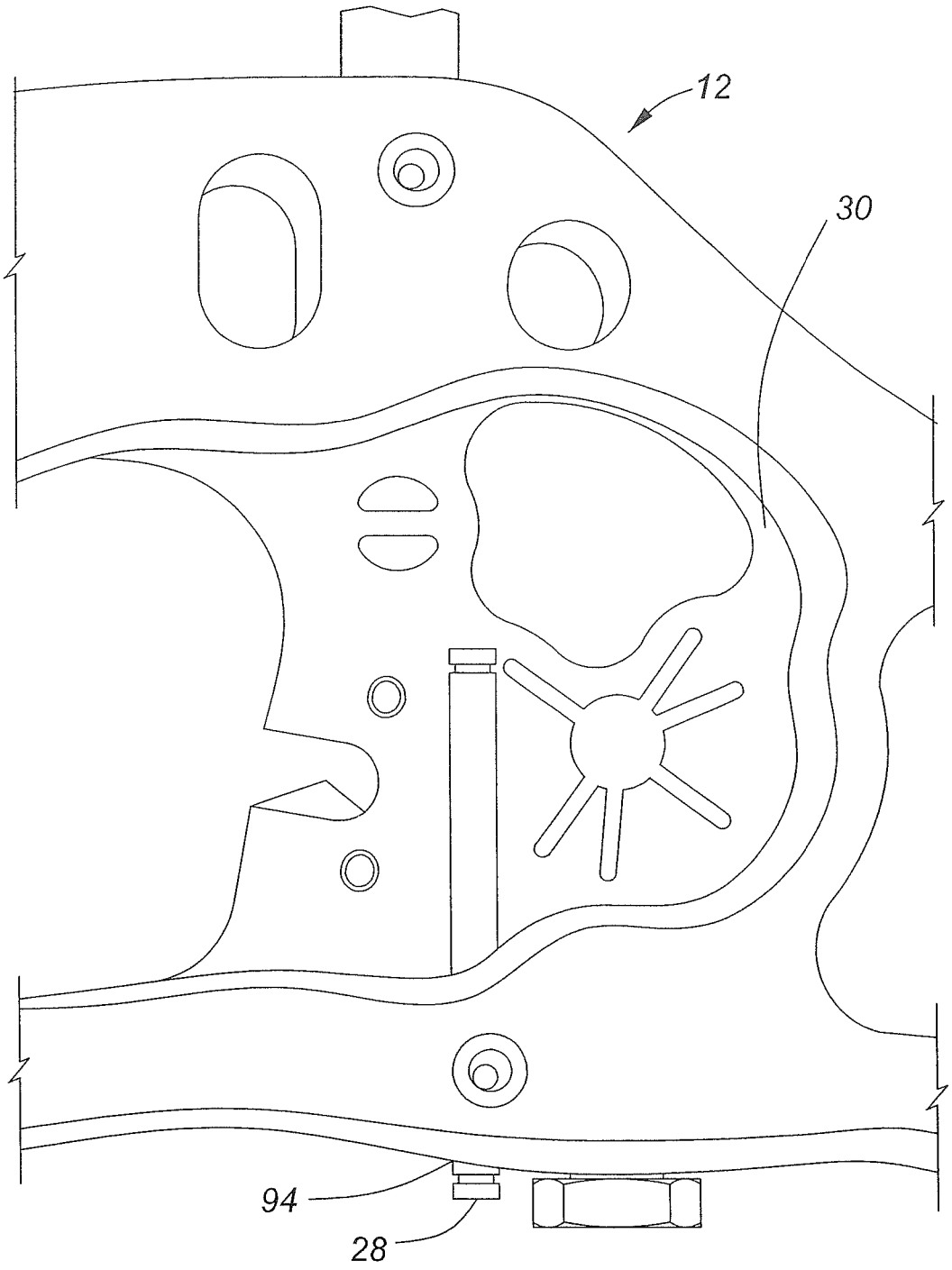
FIG. 6 is a detailed side view of a bow and cam lock in a stored position.

As illustrated in FIG. 1 and in the close-up view of FIG. 6, the member 28 may be attached to the bow 10 for storage when not in use. The member 28 may be retained in slot 94 in the riser 14 or clipped or otherwise attached to the bow 10, 50. In one embodiment, the member 28 may have the same dimensions and construction as an axle 32, 53, 55 for the bow 10, 50 so that the member 28 may be used as a replacement axle if repairs are needed when the bow is in use.

It will be appreciated that a similar cam and cam stop, lock or anti-rotation mechanism may be applied for other compound bow configurations such as a cam and a half bow, compound cross-bow or a binary cam bow. For a cam and a half bow, the bow string may comprise two portions with a first portion routed from the cam on the lower limb and terminated at the wheel and a second portion routed from the wheel and terminated at the cam. In this configuration a cam and cam stop may be used on the cam on the lower limb in order to relax the tension on the bow string or the power cable. In another embodiment of the cam and a half bow, a lock may be provided on the wheel on the upper limb to lock the wheel in a rotated position and relax tension on the bow string only.

Figure 7:
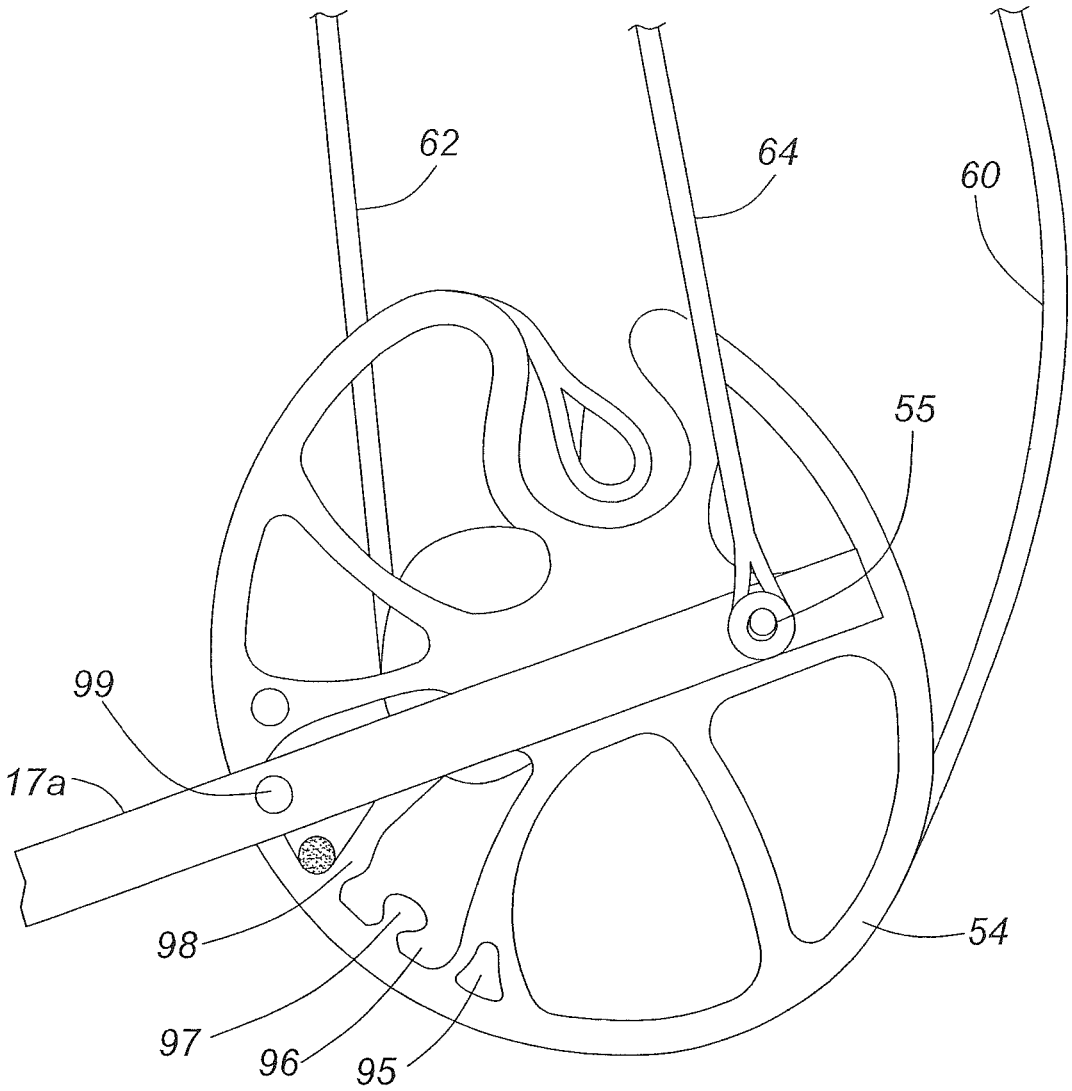
FIG. 7 is a detailed side view of a cam and various alternative cam locks.

FIG. 7 illustrates alternative cam stop mechanisms. For example, an aperture 95 may be non-circular; for example, it may be triangular for receiving a similarly triangular shaped member (not shown). An aperture 96 may be irregular in shape and include a notched portion 97 for engaging member (not shown). An aperture may be defined by portions of the cam such as spokes 98. Alternatively, an aperture 99 also may be provided through the forks 17*a* and 17*b* and aligned with an aperture in the cam 22. The apertures in the cam 22 and forks 17*a*, 17*b* thus receive the member 28 to block rotation of the cam 22 in any direction.

The cam stop also may be provided with a first portion for engaging one fork of a bifurcated limb and second portion for engaging the other fork of the limb. Alternatively, a cam stop may be provided on the forks of the limb to engage a portion of the cam and lock the cam in a selected rotational position. For example, one or more locks or hooks may be provided on the limb or on the forks to engage an aperture or corresponding lock or hook on the cam.

Figure 8:
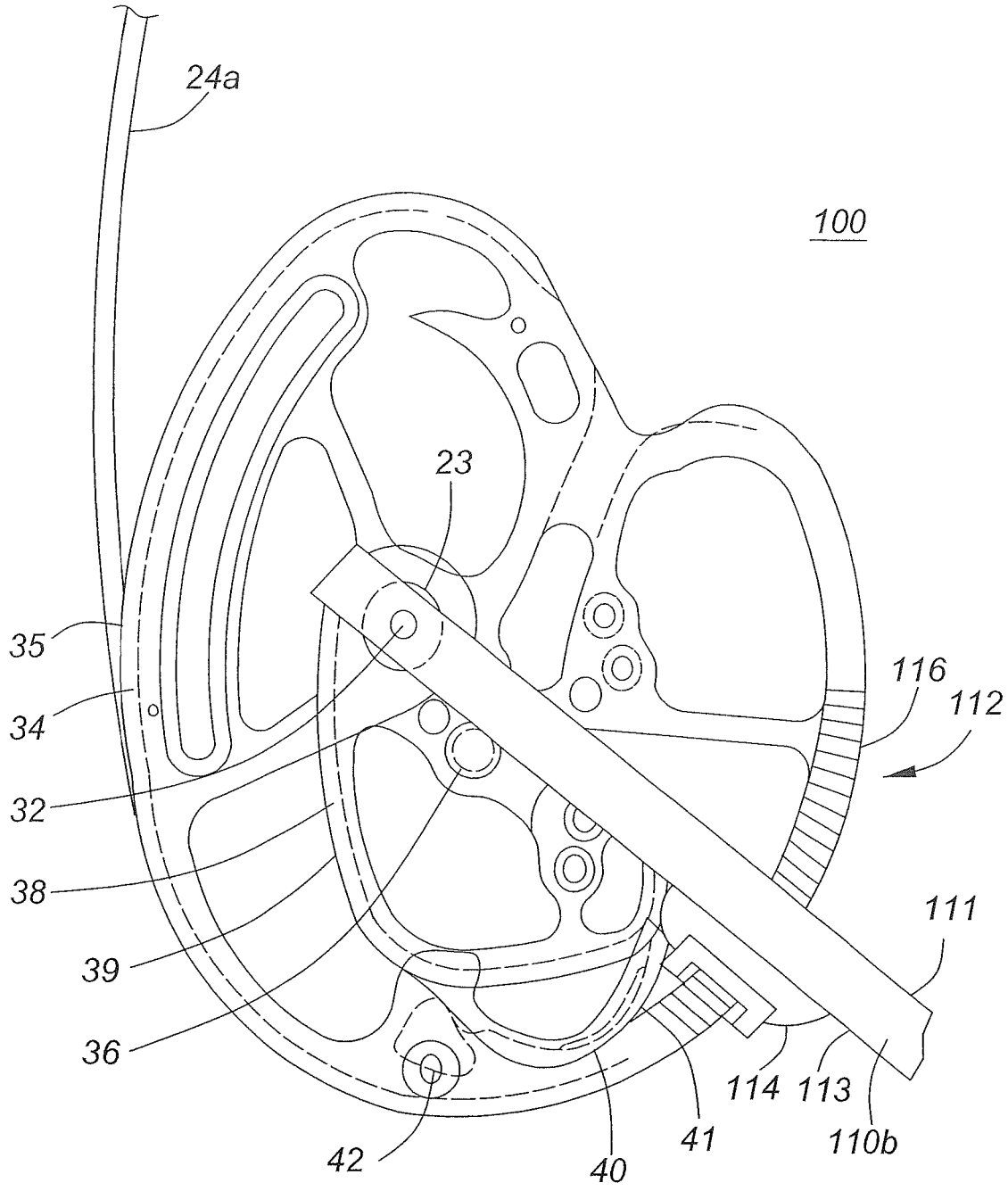
FIG. 8 is a detailed side view of the cam portion of a single cam bow and a cam lock, and related components according to an alternative embodiment of the present disclosure.
Figure 9:
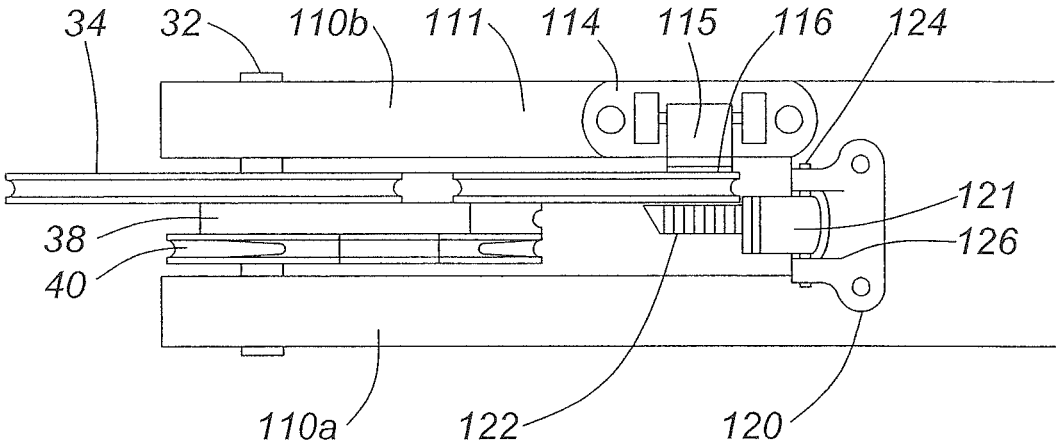
FIG. 9 is a bottom view of the cam and cam lock of FIG. 8.

FIGS. 8 and 9 illustrate an alternative embodiment of the present disclosure. The cam 100 consists of a structure having an irregular generally disc-shaped body which is rotatably mounted on axle 32 extending between the forks 110*a* and 110*b* of the limb 110. The cam has one or more tracks 34, 38, 40, and grooves 35, 39, 41 for receiving either the bow string 24 or a power cable 26 as described above in respect of FIG. 2. The routing and mounting of the second end loop 24*b* and power cable 26 are not shown in FIG. 8.

A cam stop 112 is provided consisting of a ratchet 114 including a pawl 115 mounted on the limb 110 and a corresponding rack 116 located on the cam 100. In one embodiment, the pawl 115 is mounted on a bottom side 111 of one of the forks 110*b* with the pawl 115 facing the cam 100 and rack 116. The rack 116 is located along an outer periphery of the cam 100, such as on one or both sides of the track 34. The rack 116 protrudes outwardly in a lateral direction from the cam 100. The ratchet 114 prevents rotation of the cam 100 in a first direction. A second ratchet (not shown) may be mounted on a top side 113 of the fork 110*b* to engage the rack 116. The second ratchet may be set to prevent rotation of the cam 100 in a second direction, opposite the first direction. Alternatively, a second ratchet (not shown) may be mounted on the fork 110*a* and engage a second rack (not shown), similar to the rack 116, on the opposite side of the cam 100.

In a further alternative embodiment, a ratchet 120 may be provided between the forks 110*a* and 110*b* and facing the track 34 of the cam 100. As shown in FIG. 9, the pawl 121 of the ratchet 120 may be mounted on the center of the limb 110 at the base of the forks 110*a* and 110*b* for engaging a second rack 122 on the cam 100. The rack 122 is located along an outer periphery of the cam 100, such as on the track 34, and the teeth of the rack protrude radially outward from the cam 100, the teeth of the rack facing the pawl 121.

As best seen in FIG. 9, the ratchet 120 comprises a pawl 121 which may be rotatable about a pivot 124 so as to selectively engage the pawl 121 with the rack 122 to lock the cam 100. The pawl 121 may be rotated away from the cam 100 when the cam 100 and bow are in operation. A spring 126 may be provided to bias the pawl 121 away from the cam 100 during normal operation. Alternatively, the ratchet 120 may be slidably mounted on the limb 110 and moved into a position to engage the rack 122 on the cam 110. A similar spring (not shown) or slidable engagement mechanism may be provided on the ratchet 114.

With reference to the ratchet 120 illustrated in FIG. 9, to perform maintenance on the bow, a user holds the bow 10 in a position for maintenance and the cam 100 is rotated in a first direction as described above. The ratchet 120 is actuated so that the pawl 121 engages the rack 122 to prevent rotation of the cam 100 back to the static position, thereby removing tension in the bow string 24 or the power cable 26. Once maintenance is complete, the ratchet 120 may be de-actuated or released to allow the cam 100 to rotate back to a static position. A second cam stop (not shown) may be provided and actuated to prevent rotation of the cam 100 in the opposite direction.

While this invention has been described in conjunction with specific embodiments thereof, it is evident that the invention is not limited to these specific embodiments. Rather, numerous alternatives, modifications and variations will be apparent to those skilled in the art in light of the foregoing description, as well as the present specification as a whole including the claims. Accordingly, the purpose and intention of the inventors is to embrace and include all reasonably foreseeable alternatives, modifications and variations as fall within the broad scope of the invention as described and claimed herein.

What is claimed is:

1. A cam for engaging a bow string and power cable of an archery bow, the archery bow having opposed limbs, the cam comprising:

a cam body;

a mount for rotatably mounting the cam body to one of said limbs about an axis;

at least one first cam surface on said cam body for receiving the bow string;

at least one second cam surface on said cam body for receiving the power cable; and a selectively actuatable cam stop to prevent rotation of the cam about said axis in a first direction beyond a first circumferential position when the cam is rotated in a second direction opposite the first direction and the cam stop is actuated, wherein actuation of the cam stop decreases tension on said bow string or said power cable when engaged to said cam surfaces and increases tension on the other of said bow string or said power cable, and deactuation of said cam stop permits free rotation of said cam body about said axis in either direction to restore tension on said bow string or power cable, the cam stop comprising at least one aperture within the cam body and a member configured to fit within said aperture, which when actuated, protrudes outwardly from both sides of the cam to contact first and second forks of the limb when said cam is mounted to said limb in order to prevent rotation of said cam in said first direction.

2. The cam of claim 1 wherein said member is removable from said cam.

3. The cam of claim 1 comprising a plurality of said apertures.

4. The cam of claim 1 wherein said cam stop is actuatable to selectively prevent rotation of said cam body in either direction about said axis.

5. The cam of claim 3 wherein, when said cam is rotated in said second direction, actuation of the cam stop and fitting of the member within a first aperture prevents rotation of said cam in said first direction, and when said cam is rotated in said first direction, actuation of the cam stop and fitting of the member within a second aperture prevents rotation of said cam in said second direction.

6. The cam of claim 1 wherein the cam stop comprises at least two apertures within the cam body.

7. The cam of claim 1 wherein the at least one aperture within the cam body comprises an irregularly shaped aperture adapted to receive said member.

8. The cam of claim 1 wherein the member comprises a cylindrical member and wherein the at least one aperture comprises a series of circular apertures within the cam body adapted to receive the cylindrical member.

9. An archery bow comprising:

a pair of opposed limbs;

a bow string routed between said limbs;

at least one power cable routed between said limbs;

at least one cam rotatably mounted to one of said limbs about an axis, said cam comprising a cam body, at least one first cam surface on said cam body for receiving the bow string and at least one second cam surface on said cam body for receiving the at least one power cable; and a selectively actuatable cam stop to prevent rotation of the cam about said axis in a first direction beyond a first circumferential position when the cam is rotated in a second direction opposite the first direction and the cam stop is actuated, wherein actuation of the cam stop decreases tension on said bow string or said power cable when engaged to said cam surfaces and increases tension on the other of said bow string or said power cable, and deactuation of said cam stop permits free rotation of said cam body about said axis in either direction to restore tension on said bow string or power cable, the cam stop comprising at least one aperture within the cam body and a member configured to fit within said aperture, which when actuated, protrudes outwardly from both sides of the cam to contact first and second forks of one of the pair of opposed limbs in order to prevent rotation of said cam in said first direction.

10. The bow of claim 9 wherein said cam stop is incorporated within said cam.

11. The bow of claim 9 where said cam stop is actuatable to selectively prevent rotation of said cam body in either direction about said axis for detensioning either of said bow string or said power cable.

12. The bow of claim 9 comprising first and second cams mounted to said opposed limbs, respectively, and corresponding first and second selectively actuatable cam stops.

13. The bow of claim 9 wherein said member is removable from said cam.

14. The bow of claim 9 further comprising a plurality of said apertures.

15. The bow of claim 9 wherein each of the pair of opposed limbs comprises a solid limb, each limb terminating in the first and second forks.

16. The bow of claim 9 wherein each of the pair of opposed limbs comprises a split limb and wherein the first and second forks comprise first and second limbs of the split limb.

17. The bow of claim 9 further comprising first and second power cables routed between said limbs;

a first cam mounted to an upper limb of the pair of opposed limbs about a first axis, said first cam having a cam body, a first cam surface on said cam body for receiving the bow string and a second cam surface on said cam body for receiving the second power cable;

a second cam mounted to a lower limb of the pair of opposed limbs about a second axis, said second cam having a cam body, a first cam surface on said cam body for receiving the bow string and a second cam surface on said cam body for receiving the first power cable;

said first cam having a selectively actuatable first cam stop to prevent rotation of the first cam about said first axis in a first direction beyond a first circumferential position when the first cam is rotated in a second direction opposite the first direction and the first cam stop is actuated, wherein actuation of the first cam stop of the first cam decreases tension on said bow string and said second power cable when engaged to said cam surfaces and increases tension on said first power cable, and deactuation of said cam stop permits free rotation of said cam body about said first axis in either direction to restore tension on said bow string and said first power cable;

said second cam having a selectively actuatable second cam stop to prevent rotation of the second cam about said second axis in a first direction beyond a first circumferential position when the second cam is rotated in a second direction opposite the first direction and said second cam stop is actuated, wherein actuation of said cam stop decreases tension on said bow string and said second power cable when engaged to said cam surfaces and increases tension on said first power cable, and deactuation of said cam stop permits free rotation of said cam body about said second axis in either direction to restore tension on said bow string and said second power cable; and said first and second cam stops comprising at least one aperture within the cam body of the first cam and at least one aperture within the cam body of the second cam and a member configured to fit within said at least one aperture within the cam body of the first or second cam, which member, when actuated, protrudes outwardly from both sides of the first or second cam to contact first and second forks of said upper or lower limb in order to prevent rotation of said first or second cam in said first direction.

18. A method for decreasing tension in a bow string or power cable of an archery bow to perform maintenance thereon, comprising the steps of:

providing an archery bow comprising a pair of opposed bow limbs, a bow string routed between said limbs, at least one power cable, and at least one cam rotatably mounted to one of said limbs about an axis, said cam comprising a cam body, at least one first cam surface on said cam body for receiving the bow string and at least one second cam surface on said cam body for receiving the at least one power cable, and a selectively actuatable cam stop, said selectively actuatable cam stop comprising at least one aperture within the cam body and a member configured to fit within said aperture;

rotating said cam in a first direction;

actuating the cam stop to protrude outwardly from both sides of the cam to contact first and second forks of one of the pair of opposed limbs in order to prevent back-rotation of said cam in a second direction opposed to said first direction; and wherein actuating the cam stop locks the cam at a first circumferential position thereby increasing tension in said power cable or said bow string, and decreasing tension in the other of said bow string or said power cable.

19. The method of claim 18 wherein rotating said cam in said first direction comprises tensioning one of said bow string or said power cable.

20. The method of claim 19 further comprising, after actuating the cam stop, releasing said bow string or said power cable.

21. A method as defined in claim 18 wherein the bow comprises an upper cam mounted to one of said limbs, a lower cam mounted to the second said limb, and two power cables routed between the upper and lower cams.

22. A method for decreasing tension in a bow string or power cable of an archery bow to perform maintenance thereon, comprising the steps of:

providing an archery bow comprising an upper limb and an opposed lower limb, a bow string, at least two power cables, an upper cam rotatably mounted to the upper limb, and a lower cam rotatably mounted to the lower limb, each of said upper and lower cam comprising a cam body, at least one first cam surface on said cam body for receiving the bow string and at least one second cam surface on said cam body for receiving the at least one power cable, and a selectively actuatable cam stop, said selectively actuatable cam stop comprising at least one aperture within the cam body of the first cam and at least one aperture within the cam body of the second cam and a member configured to fit within said at least one aperture within the cam body of the first or second cam, rotating one of said upper cam or said lower cam in a first direction;

actuating the cam stop to protrude outwardly from both sides of said upper or lower cam to contact first and second forks of said upper or lower limb in order to prevent back-rotation of said upper or lower cam in a second direction opposed to said first direction; and wherein actuating the cam stop locks said upper or lower cam at a first circumferential position thereby increasing tension in one of said power cables and decreasing tension in said bow string and in the other of said power cables.

* * * * *